US008573018B2

(12) United States Patent
Caudill et al.

(10) Patent No.: US 8,573,018 B2
(45) Date of Patent: Nov. 5, 2013

(54) SYSTEM FOR MANUFACTURING WIRE

(75) Inventors: Gregory S. Caudill, Fort Wayne, IN (US); Joshua S. Jur, Fort Wayne, IN (US)

(73) Assignee: Essex Group, Inc., Atlanta, GA (US)

( * ) Notice: Subject to any disclaimer, the term of this patent is extended or adjusted under 35 U.S.C. 154(b) by 737 days.

(21) Appl. No.: 12/688,783

(22) Filed: Jan. 15, 2010

(65) Prior Publication Data

US 2011/0174041 A1 Jul. 21, 2011

(51) Int. Cl.

| | |
|---|---|
| ***B21C 1/04*** | (2006.01) |
| ***B21C 1/10*** | (2006.01) |
| ***B21C 1/02*** | (2006.01) |
| ***B21B 45/00*** | (2006.01) |

(52) U.S. Cl.
USPC ..... 72/278; 72/46; 72/280; 72/289

(58) Field of Classification Search
USPC ..... 72/46, 226–228, 234, 274, 278, 280, 72/206, 289
See application file for complete search history.

(56) References Cited

U.S. PATENT DOCUMENTS

| | | | | |
|---|---|---|---|---|
| 4,573,336 | A * | 3/1986 | Hagglund | 72/278 |
| 5,537,849 | A * | 7/1996 | Kawakami et al. | 72/46 |
| 2010/0180652 | A1 * | 7/2010 | Ichikawa et al. | 72/46 |

FOREIGN PATENT DOCUMENTS

| | | | |
|---|---|---|---|
| JP | 57-152314 | A * | 9/1982 |
| JP | 2005-103623 | A * | 4/2005 |

* cited by examiner

*Primary Examiner* — Dana Ross
*Assistant Examiner* — Mohammad I Yusuf

(57) ABSTRACT

A system for manufacturing wire having a mill and a finishing station configured to receive the wire output from the mill in a continuous fashion. The mill has first and second dies and first and second capstans. The first die is configured to receive a wire having a first cross-sectional area and to reduce the cross-sectional area of the wire as it passes through the first die. The first capstan is configured to receive the wire from the first die and apply a first force on the wire. The second die is configured to receive the wire from the first capstan and to further reduce the cross-sectional area of the wire as it passes through the second die. The second capstan is configured to receive the wire from the second die and apply a second force on the wire. The wire exits the mill having a second cross-sectional area that is smaller than the first cross-sectional area, and is finished by the finishing station.

20 Claims, 10 Drawing Sheets

304

114

108

108

108

SYSTEM FOR MANUFACTURING WIRE

FIELD OF THE INVENTION

This invention relates generally to the field of wire manufacturing, and more specifically to manufacturing of wire from stock metal materials.

BACKGROUND OF THE INVENTION

The conventional process of creating enameled wire requires two steps. The first step requires converting raw materials (generally copper or aluminum rod coils, often referred to in the industry as rod stock) to wire. This process involves elongating and shaping the copper rod into wire. This is conventionally performed in a machine known in the industry as a rod breakdown machine, which can create one or two wires at a time, and operates at a very high speed. The output from rod breakdown process is typically referred to as process wire.

The second step involves coating the wire with enamel. The conventional enamel coating process involves passing the processed wire through an enameling oven, which coats the wire with enamel and then bakes the enamel to harden the enamel coating. The enameling process is much slower than the process wire manufacturing process.

Because of the difference in speed, the conventional practice in the industry is to produce large volumes of process wire using high-speed rod breakdown machines and to store the resulting process wire on spools or in baskets in a storage area. Then, when enameling is desired, a spool or basket of process wire is retrieved from the storage area and fed into the enameling oven to create the enameled wire.

This multi-step process can be inefficient. Having to produce and store process wire before enameling makes just-in-time production of custom (or small-batch) orders of enameled wire difficult. It also may result in the use of storage space for process wire that may not be enameled for a very long time.

Accordingly, a need exists for a system of processing raw rod stock into wire, which is then passed directly into an enameller without storing the wire before enameling.

SUMMARY OF THE INVENTION

The present invention can satisfy the above-identified needs by providing a system for manufacturing wire. The system for manufacturing wire includes a mill that can have a first die that can receive a wire having a first cross-sectional area and reduce the cross-sectional area of the wire as it passes through the first die. The mill can also have a first capstan that receives the wire from the first die and applies a first force on the wire. The mill can also have a second die that receives the first wire from the first capstan and further reduces the cross-sectional area of the wire as it passes through the second die. The mill can also have a second capstan configured to receive the wire from the second die and apply a second force on the wire. The first capstan and the second capstan can each be driven by individual motors. Each motor can be controlled by a computer.

The mill can also have a third die that can receive the wire from the second capstan and further reduce the cross-sectional area of the wire as it passes through the third die. The mill can also have a third capstan that can receive the wire from the third die and apply a third force to the wire. The mill can also have a fourth die that can receive the wire from the third capstan and further reduce the cross-sectional area of the wire as it passes through the fourth die. The mill can also have a fourth capstan that can receive the wire from the fourth die and apply a fourth force to the wire.

When the wire exits the mill, it can enter into a finishing station in a continuous fashion. The finishing station can be an enameller, and finishing the wire can include applying an enamel to the wire. When entering the finishing station, the wire can have a second cross-sectional area that is smaller than the first cross-sectional area. The first cross-sectional area can be one of 3 AWG to 15 AWG. The second cross-sectional area can be one of 4 AWG to 16 AWG. The wire can also be received by a flattener configured to flatten at least one side of the wire. The flattener can also flatten the wire to produce a wire that is substantially square in cross section after exiting the flattener. The flattener can include a roller.

The mill can also have a finish capstan that can receive the wire from the finishing station and apply a finish force to the wire. After finishing the wire continuously feeds the enamel operation.

Additional aspects, objects, features, and advantages of the invention will become apparent to those having ordinary skill in the art upon consideration of the following detailed description of exemplary embodiments. For a more complete understanding of the exemplary embodiments of the present invention and the advantages thereof, reference is now made to the following description in conjunction with the accompanying drawings described below.

DETAILED DESCRIPTION OF EXEMPLARY EMBODIMENTS

Figure 1:
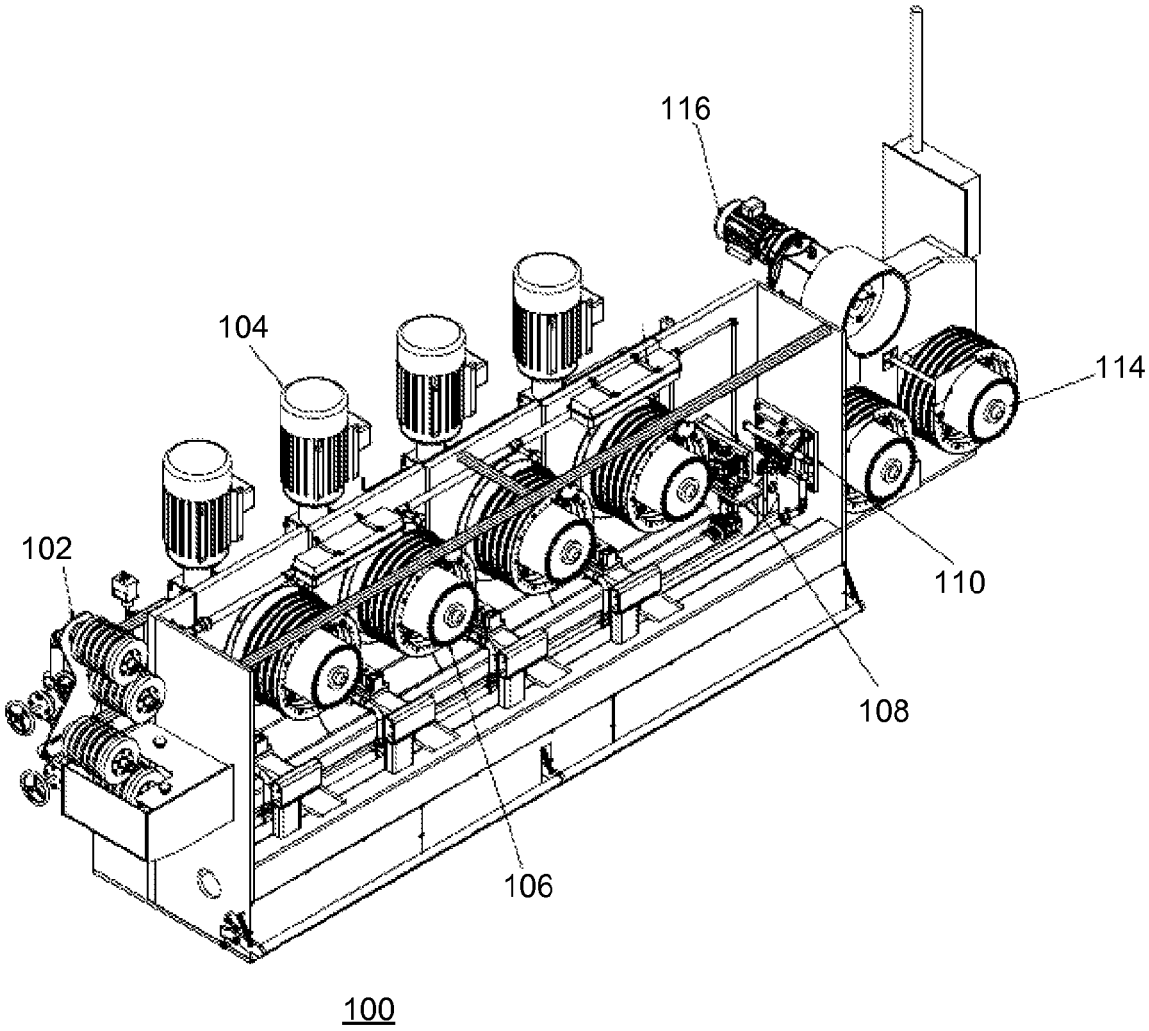
FIG. 1 is a schematic illustration depicting the functional components of a rod breakdown machine configured to convert rod stock into finished wire according to an exemplary embodiment of the present invention.

Turning now to FIG. 1, a schematic illustration depicting the functional components of an inline rod breakdown machine 100 (referred to herein as either a rod breakdown machine, rod mill, or mill) configured to convert rod stock into finished wire according to an exemplary embodiment of the present invention is shown. In this embodiment, the rod mill 100 includes entrance rollers 102 that receive rod stock and guides the rod stock into the mill 100. In an exemplary embodiment, the rod stock may be 5/16 inch copper rod, but can be of varying sizes, including, without limitation rod stock ranging from 3 AWG to 15 AWG and can be of other suitable materials for making wire such as, but not limited to, aluminum. In the exemplary embodiment of FIG. 1, the entrance rollers 102 include five grooves for guiding the rod stock into the rod mill 100, and accordingly, the rod mill 100 can process up to five lines of rod stock at a time. In an alternative exemplary embodiment, the rollers can be configured with differing numbers of grooves such that the rod mill 100 can process additional simultaneous lines of rod stock. One of ordinary skill in the art would understand that the number of simultaneous wires that can be processed at a given time by the rod mill 100 is limited only by environmental factors within a particular facility, such as the size of the facility and the number of lines that equipment associated with subsequent processing stages, such as the enameling oven, can accept at a given time.

After passing through the entrance rollers 102, the rod stock passes into the rod mill 100 where it encounters a series of dies and capstans 106. Each die is configured such that, when wire stock is drawn through the die, the wire stock elongates and assumes a lesser diameter (i.e., the cross-sectional area of the wire is reduced). To draw wire through a die, wire stock is passed through a die and around a capstan. The capstan then rotates, applying a pulling force to the wire that forces the wire through the die. In an exemplary embodiment, the rod mill 100 includes four sets of dies and capstans 106. However, in alternative exemplary embodiments, the rod mill 100 can include any number of sets of dies and capstans 106, limited only by available manufacturing space. Further, not every capstan and die needs to be used in every wire run. Depending on the amount by which the diameter of the wire stock must be reduced, the rod mill 100 may be run using as few as one die and capstan 106.

Generally, after passing through the various dies, the wire will be circular in cross section. Circular wire is preferred for most applications. Certain applications, however, call for square wire. If square wire is desired, the wire may be passed through a flattener assembly 108, which uses a series of rollers to flatten two or four sides of the wire.

Once the wire has passed through the flattener 108 (or, if the flattener 108 is not being used, exits the final in-use capstan), the wire passes through a finish die 110. The finish die 110 is generally sized to provide the final size and shape of the wire. The finish die 110 may be configured to shape either a round or square wire (or both, depending on the application. Once wire exits the finish die 100, it is milled and ready for further processing, such as enameling.

Following the finish die 110 are two finish capstans 114. The finish capstans apply the final force to the wire to pull the wire through the finish die. In an exemplary embodiment, the wire then passes up to a booster capstan 116 that is used to assist in pulling the finish wire from the rod breakdown machine and elevate the wire for distribution to other areas of the manufacturing facility. In an alternative exemplary embodiment, the wire passes around the finish capstans 114 and out of the mill 100.

Once the wire has exited the mill 100, the wire passes to a finishing station (not shown). In an exemplary embodiment, the finishing station is an oven or other apparatus that is used to apply one or more coatings to the wire, such as enamel, plastic, or other coatings known to those of skill in the art. In alternative exemplary embodiments, the finishing station may perform other post-milling processing on the wire, such as any ferrous or non-ferrous manufacturing process such as further size reduction, cleaning, or annealing or coating.

When wire is being passed directly into a finishing station, the speed at which the finishing station operates must be accounted for in the operation of the mill. By way of example, conventional enameling machines run very slowly, moving wire through the system at speeds as slow as 35 feet per minute. On the other hand, conventional rod mills 100 process wire very quickly, often as fast as 3,500 feet per minute.

Accordingly, because of this significant difference in speed, wire exiting from conventional rod mills 100 must be spooled or placed in baskets and stored until it can be processed in the finishing station at a later time.

To allow wire to pass directly from the rod mill 100 to the finishing station without an intermediate step of spooling and storing the processed wire, the capstans 106 of the rod mill 100 operate at a slower speed than conventional capstans. However, to draw the wire through the dies such that the wire stretches properly, each capstan must generate the same amount of force per wire line as conventional capstans that operate at a much faster rate. To achieve the appropriate amount of force, and also to allow for greater flexibility in capstan speeds, in an exemplary embodiment of the present invention, each capstan 106 in the rod mill 100 is powered by its own AC motor 104. The capstan speed can then be controlled for each individual capstan 106, and varied for any possible combination of dies and finishing station speeds. In an exemplary embodiment, each motor 104 is coupled to a central computer that dictates the speed of each motor 104. The computer can be programmed with the die diameters installed in the rod mill 100, the desired input size, and the desired output size. The computer can then fix the speed of each motor such that the capstans will turn at the appropriate speed for the particular configuration. The individual motor speeds can then be adjusted during operation as needed. Table 1, below, sets forth certain exemplary configurations of the present invention that can be used to convert an input of 5/16" copper rod into wire of varying sizes (in AWG).

TABLE 1

| | Example 1 | | Example 2 | | Example 3 | |
|---|---|---|---|---|---|---|
| Die | Die Size (AWG) | Capstan RPM | Die Size (AWG) | Capstan RPM | Die Size (AWG) | Capstan RPM |
| 1 | 1.5 | 1.27 | 1 | 1.49 | 2 | 1.28 |
| 2 | 2.5 | 1.60 | 2 | 1.88 | 3 | 1.61 |
| 3 | 3.5 | 2.02 | 3 | 2.37 | 4 | 2.03 |
| 4 | 4.5 | 2.55 | 4 | 2.99 | 5 | 2.55 |

TABLE 1-continued

| Die | Example 1 | | Example 2 | | Example 3 | |
|---|---|---|---|---|---|---|
| | Die Size (AWG) | Capstan RPM | Die Size (AWG) | Capstan RPM | Die Size (AWG) | Capstan RPM |
| Finish (Output) | 5.5 | 3.22 | 5 SQ<br>6 SQ | NA<br>3.73 | 6 | 3.21 |

Figure 2:
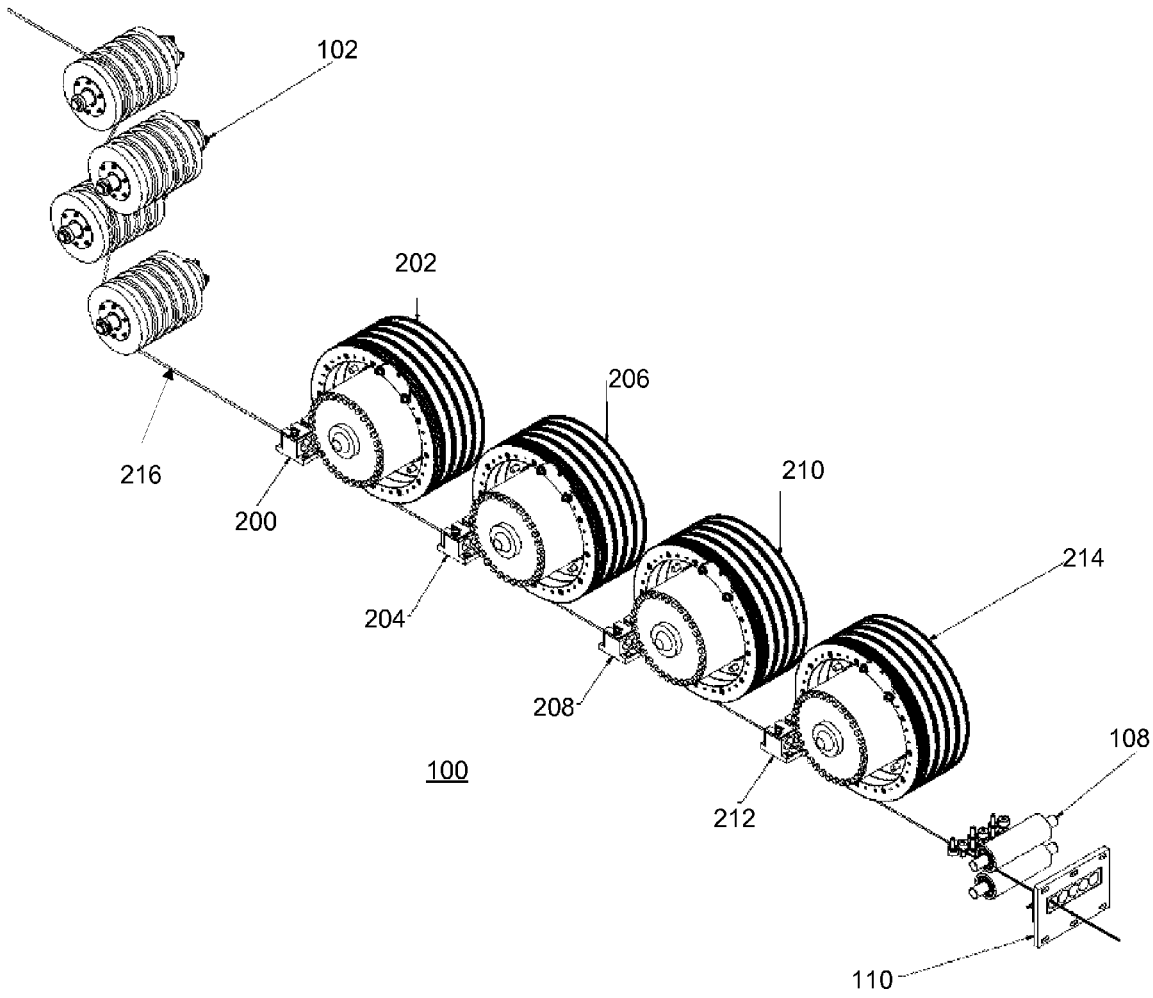
FIG. 2 is a schematic illustration depicting the wire line of a rod breakdown machine configured to convert rod stock into finished wire according to an exemplary embodiment of the present invention.

Turning now to FIG. 2, a schematic illustration depicting the wire line of a rod mill 100 configured to convert rod stock into finished wire according to an exemplary embodiment of the present invention is shown. FIG. 2 presents an additional view of the entrance rollers 102, the capstans 202, 206, 210, 214, the dies 200, 204, 208, 212, the flattener 108, and the finish die 110 as described above with respect to FIG. 1. FIG. 2 also shows a single wire 216 passing through the rod mill 100.

Figure 3:
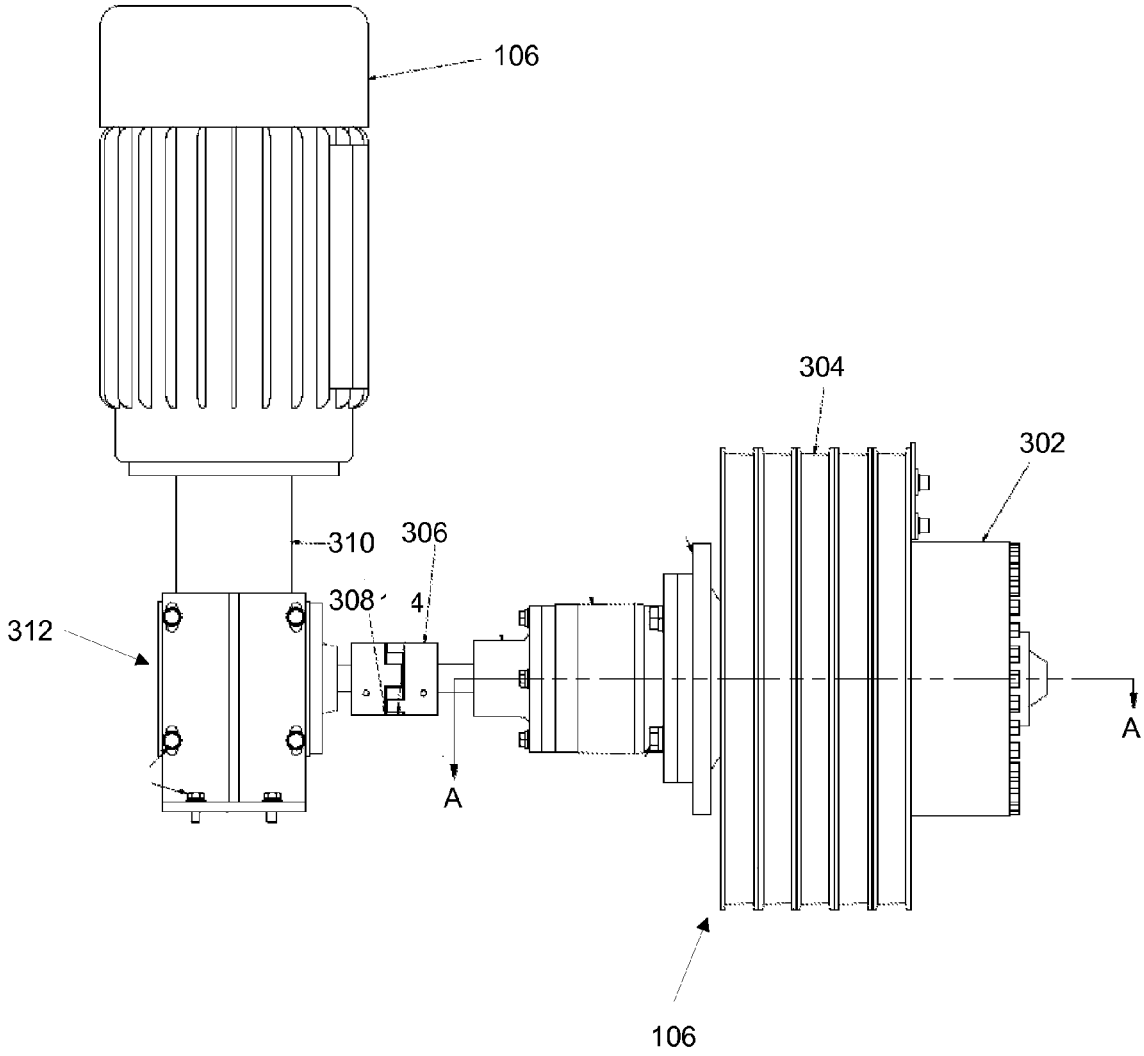
FIG. 3 is a schematic illustration depicting a capstan assembly of the rod breakdown machine of FIG. 1 according to an exemplary embodiment of the present invention.

Turning now to FIG. 3, a schematic illustration depicting a capstan assembly of the rod mill 100 of FIG. 1 according to an exemplary embodiment of the present invention is shown. The exemplary capstan 104 includes a hub 302 that is coupled to a motor 106 by a capstan shaft 306. The motor 106 drives a shaft 310 which, via a ninety-degree conversion 312 is coupled to the capstan shaft 306. The capstan shaft is coupled to a hub 302. The hub 302 is then coupled to a number of grooves 304 which are configured to receive wires passing over the capstan 104. Each groove 304 receives a single wire. In the exemplary embodiment, the capstan 104 has five grooves 304, meaning that up to five wires can be processed at a time. In an alternative exemplary embodiment, the capstan 104 may have any number of grooves 304 that are appropriate for a particular manufacturing environment. By way of example only, if a facility has an enameller that can accept up to twelve wires at a time, then the capstan 104 can be configured to have twelve grooves 304.

Conventional rod mills that have multiple capstans employ a single motor to drive two or more capstans, typically using a variety of belts and pulleys to drive each capstan. Because the speed at which a wire is drawn through a die must change depending on the size of the input wire, the size of the die, and the desired quality of the wire after being drawn, conventional rod mills 100 essentially were fixed as to the die sequences that can be used, as changing standard elongations typically involved a complicated process of changing the belts and pulleys driving the capstans to change the capstan speed to be suitable for a particular application. Accordingly, conventional machines were effectively fixed as to the types of available inputs and outputs. With a separate motor 106 for each capstan 104, however, individual motors can simply be accelerated or slowed as required for a given die or combination of dies, allowing for additional flexibility in input and output wire sizes.

Figure 4:
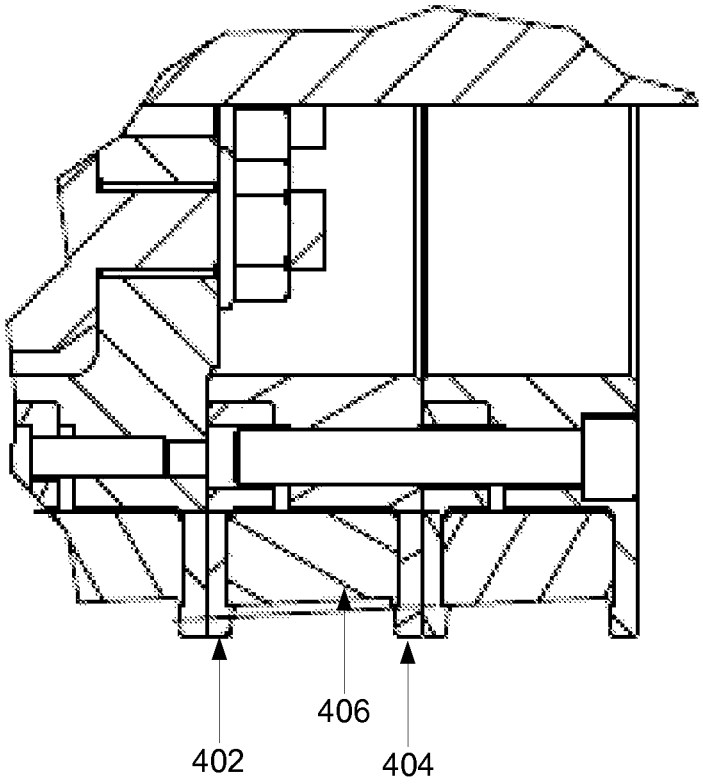
FIG. 4 is a cutaway view of the capstan of FIG. 3 according to an exemplary embodiment of the present invention.

Turning now to FIG. 4, a schematic illustration of a cutaway view (along line A) of the capstan of FIG. 3 according to an exemplary embodiment of the present invention is shown. FIG. 4 further illustrates the grooves 304. Each groove 304 has an exterior wall 404 that is disposed toward the exterior of the capstan—away from the motor. Each groove 304 also has an interior wall 402 that is disposed toward the interior of the capstan—toward the motor. Each groove 304 also has a base surface 406 which receives the wire. The base surface 406 is disposed at an angle to the walls 402, 404 of the groove such that the base forms an acute angle with respect to the exterior wall 404 and an obtuse angle with respect to the interior wall 402. This configuration causes a wire disposed in the groove 304 to move toward the exterior wall 404 of the groove 304 as the capstan turns. This ensures that the wire will remain in a consistent position when wrapped around the capstan. This is important because the groove is many times wider than the wire. The angled base assists in keeping the wire aligned with the die. In addition, the travel across groove 304 reduces the amount of rubbing and overlap between adjacent wire wraps on the capstan, which improves lubrication and cooling of the wire.

Figure 5:
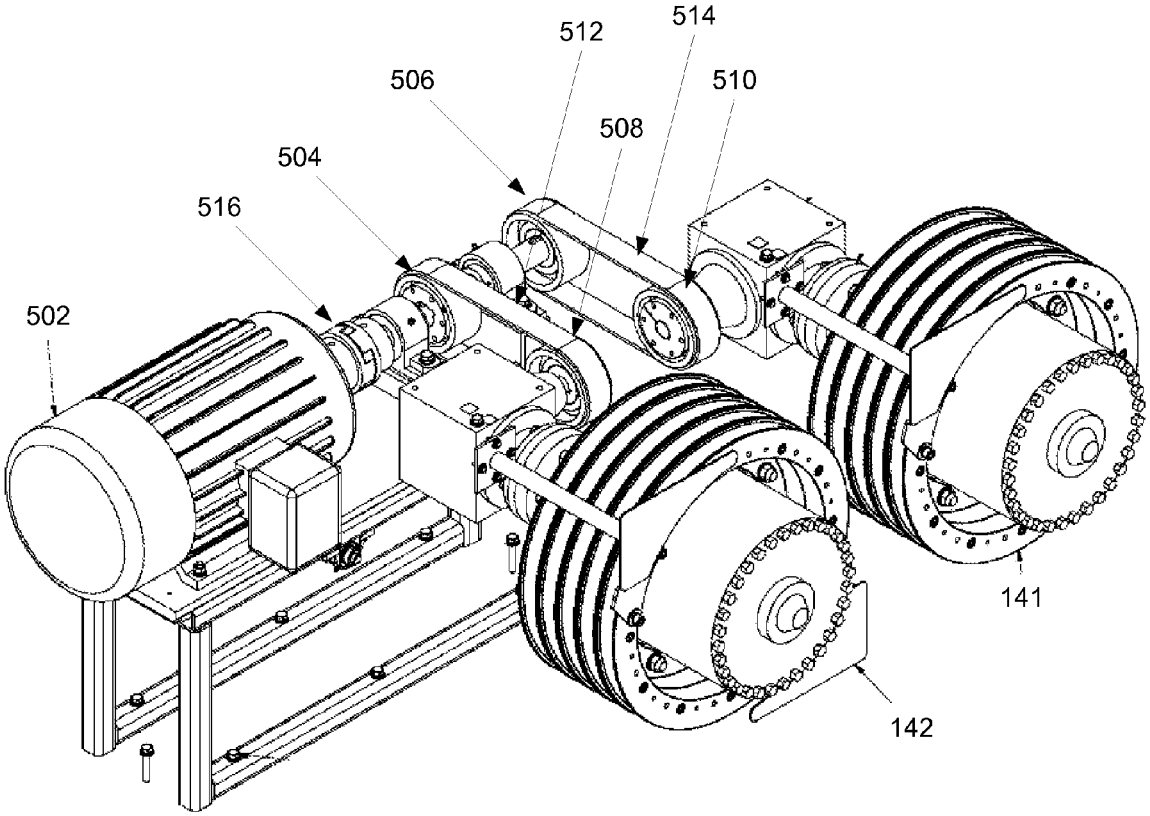
FIG. 5 is a schematic illustration depicting a finish capstan of the rod breakdown machine of FIG. 1 according to an exemplary embodiment of the present invention.

Turning now to FIG. 5, a schematic illustration depicting a finish capstan 114 of the rod mill 100 of FIG. 1 according to an exemplary embodiment of the present invention is shown. In an exemplary embodiment, the finish capstan includes two capstans 141, 142 that are driven at the same speed, and each capstan 141, 142 includes the same number of grooves as the capstans 104 within the mill 100. The finish capstans 141, 142 are driven by a single motor 502 which is coupled to pulleys 504, 506 via a shaft 516. Each pulley 504, 506 is coupled via a belt 512, 514 to a corresponding pulley 508, 510 that is coupled to each finish capstan 141, 142. This coupling mechanism ensures that each finish capstan 141, 142 rotates at the same rate. In an exemplary embodiment, the wire, upon exiting the mill 100, travels across the top of the first capstan 142, around the second capstan 141 from the 12:00 position to the 6:00 position, travels to the 6:00 position of the first capstan 142 and wraps around to the 12:00 position. This occurs for several wraps such that the wire ultimately travels up toward the booster capstan 116 from the 9:00 position of the first capstan 142.

Figure 6:
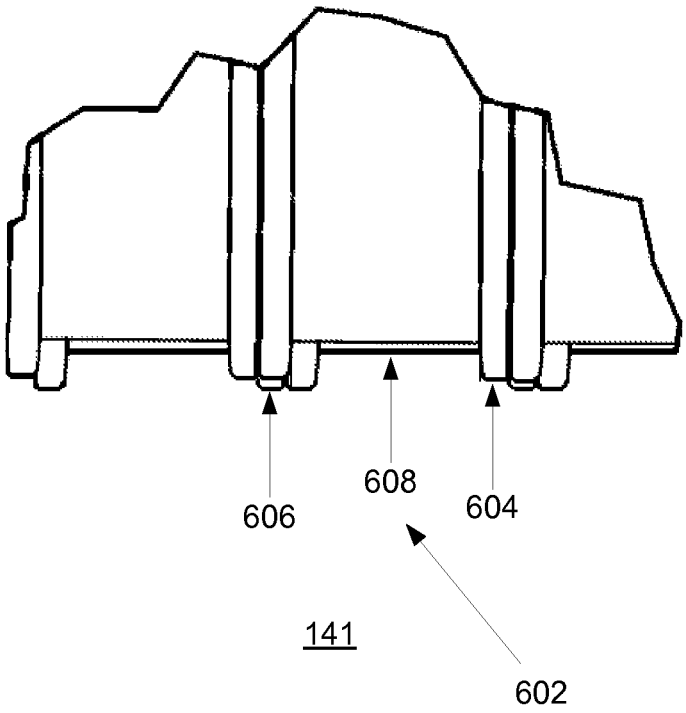
FIG. 6 is a cutaway view of the finish capstan of FIG. 5 according to an exemplary embodiment of the present invention.

Turning now to FIG. 6, a schematic illustration of a cutaway view of the finish capstans 141, 142 of FIG. 5 according to an exemplary embodiment of the present invention is shown. As described above, the finish capstans 141, 142 include grooves 602 that correspond to the grooves 602 in the mill capstans 106. Like the mill capstans 106, the grooves 612 include an exterior wall 604, an interior wall 606, and a base 608. Unlike the mill capstans 106, however, the base of the groove 602 of the finish capstan 114 is perpendicular to the walls 604, 606. The finish capstan 141 is installed at an angle to horizontal such that it imparts horizontal spacing of the wire as it wraps onto capstan 142. The flat base surface 608 allows the wire to wrap around the capstans 141, 142 multiple times (as described above) without having individual wire wraps come into contact with one another.

Figure 7:
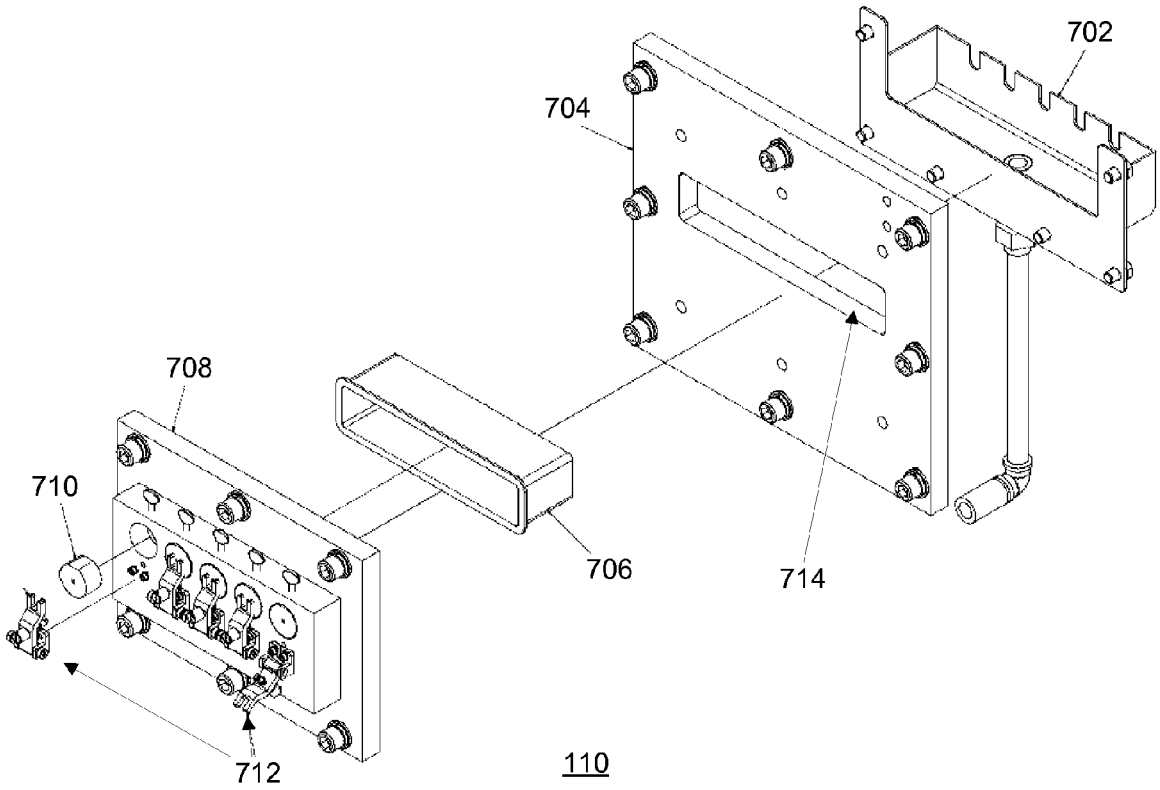
FIG. 7 is an exploded view of the finish die of the rod breakdown machine of FIG. 1 according to an exemplary embodiment of the present invention.

Turning now to FIG. 7, a schematic illustration of an exploded view of the finish die 110 of the rod mill 100 of FIG. 1 according to an exemplary embodiment of the present invention is shown. The finish die 110 includes a mount plate 704 that is used to couple the die attachment assembly 708, 710,712 to the rod breakdown machine. A drain assembly 702 configured to collect excess lubricant and recycle the lubricant back into the mill 100 is coupled directly to the outside wall of the rod breakdown machine. The mount plate includes a notch 714 configured to allow sleeve 706 and wire to pass through the mount plate 704 and out of the rod breakdown machine.

A die plate 708 is coupled to the die support member 704. In an exemplary embodiment, the die plate 708 includes one die 710 for each wire the mill 100 is capable of processing. By way of example, the die plate 708 includes five dies 710, as the exemplary mill 100 is configured to receive five wires. Each die 710 is held in place by a die clip 712, which, in the exemplary embodiment, is a hinged clip that, when closed, applies pressure to the die 710 in order to hold it in the die plate 708. In an exemplary embodiment each die 710 is the same size as each other die 710. In an alternative exemplary embodiment, each die 710 may be different, and may present different shapes. For example, certain dies 710 may be square, while others are round.

Figure 8:
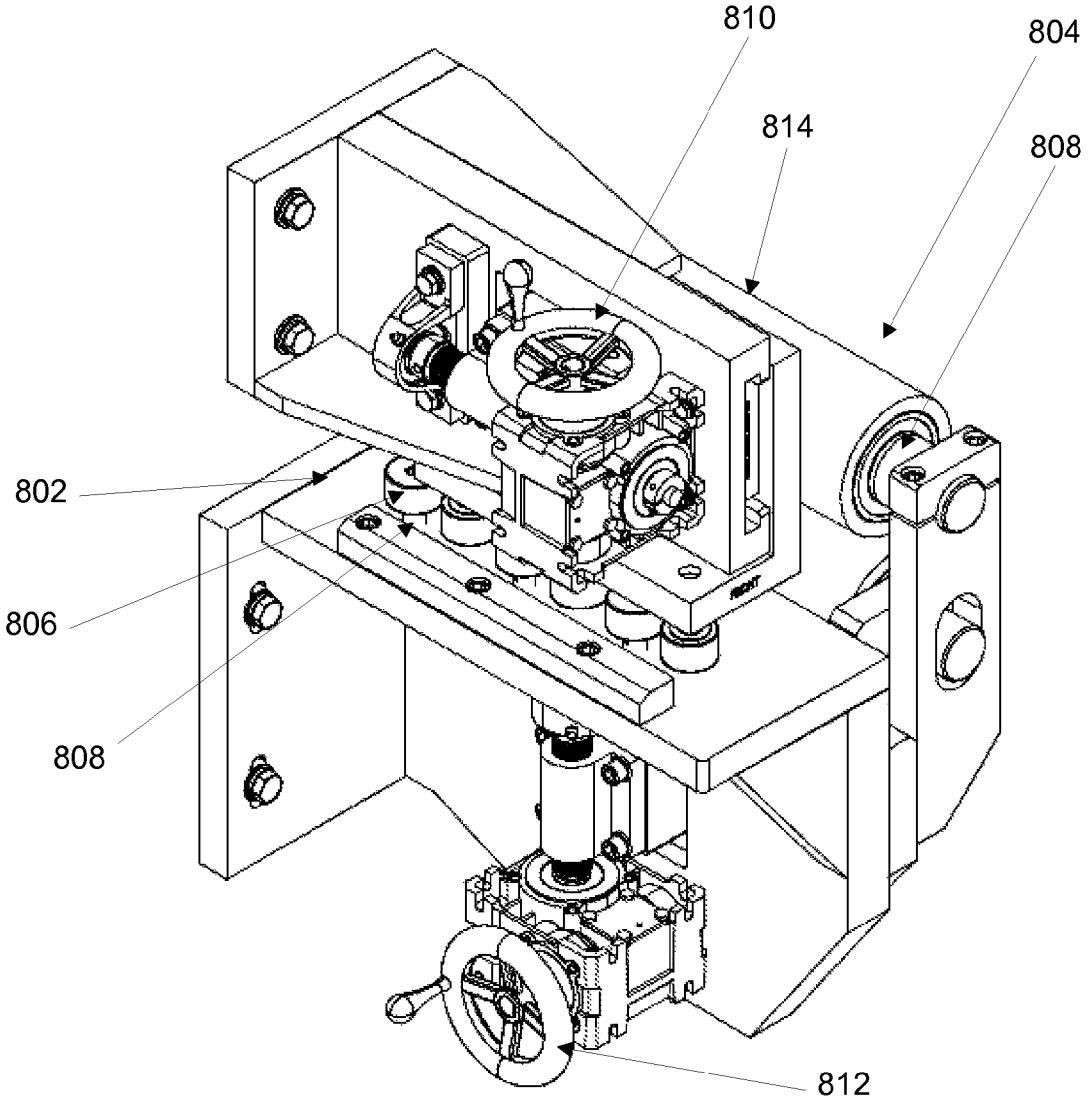
FIG. 8 is a schematic illustration of a perspective view of the flattener of the rod breakdown machine of FIG. 1 according to an exemplary embodiment of the present invention.

Turning now to FIG. 8, a schematic illustration of a perspective view of the flattener 108 of the rod mill 100 of FIG. 1 according to an exemplary embodiment of the present invention is shown. The flattener 108 includes two roller portions 802, 804 that can be used to form a wire having a round cross-section into a wire having a square cross-section. The rollers 808 in the first roller portion 802 are coupled to axles 808 that extend vertically from the flattener 108. The rollers 808 in the first roller portion 802 are configured such that a wire passing through them will be flattened on its sides.

The rollers 814 in the second roller portion 804 are coupled to axles 808 that extend horizontally from the flattener 108. The rollers 814 in the second roller portion 804 are configured such that a wire passing through them will be flattened on the top and bottom.

The flattener 108 also includes a horizontal adjustment unit 810 and a vertical adjustment unit 812. The horizontal adjustment unit 810 allows the spacing between the first rollers 806 to be adjusted to accommodate wires of varying sizes. Horizontal adjustments can be made to space the rollers 806 sufficiently apart such that they will not flatten the sides of the wire passing through the rollers.

The vertical adjustment unit 812 allows the spacing between the second rollers 814 to be adjusted to accommodate wires of varying sizes. The vertical adjustment unit also allows the second rollers 814 to be spaced sufficiently apart such that they will not contact wire passing through the rollers 814, thereby preventing the top and bottom of the wire from being flattened.

Figure 9:
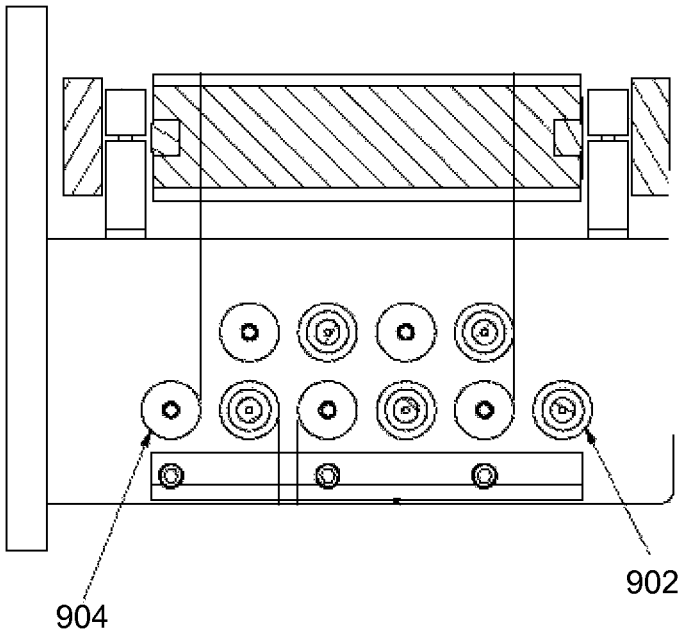
FIG. 9 is a cutaway top view of the flattener of FIG. 8 according to an exemplary embodiment of the present invention.

Turning now to FIG. 9, a schematic illustration of a cutaway top view of the flattener 108 of FIG. 8 according to an exemplary embodiment of the present invention is shown. FIG. 9 illustrates the relationship between the top first rollers 902 and the bottom first rollers 904. As shown in FIG. 9, the top first rollers 902 are aligned with the bottom first rollers 904 such that wire passing through the flattener 108 will not be compressed on the sides. By manipulating the horizontal adjustment unit 810, the top first rollers 902 will move to the left (with respect to the bottom first rollers 904), positioning the rollers close enough together to flatten the sides of wire passing through the first rollers 902, 904.

Figure 10:
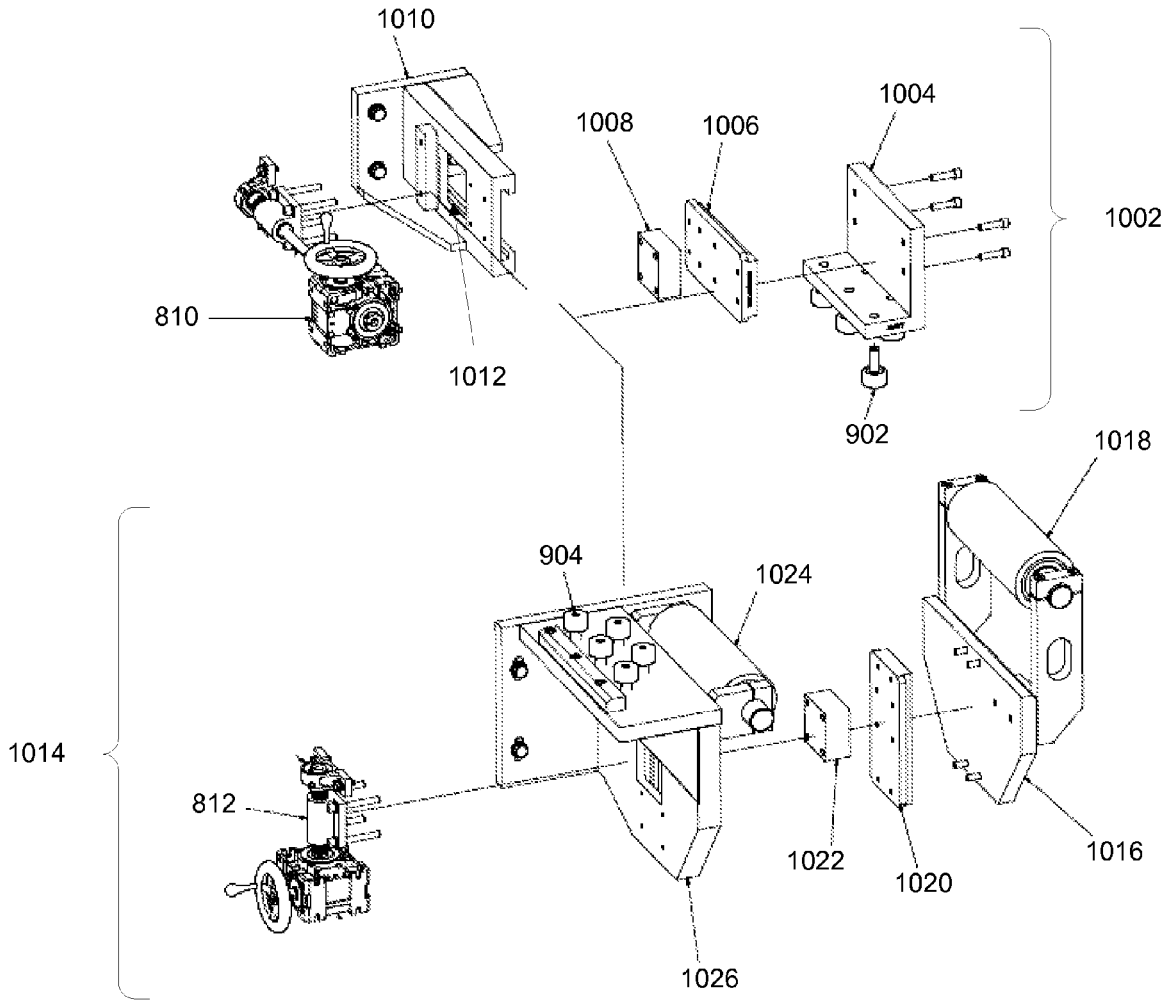
FIG. 10 is an exploded view of the flattener of FIG. 8 according to an exemplary embodiment of the present invention.

Turning now to FIG. 10, a schematic illustration of an exploded view of the flattener 108 of FIG. 8 according to an exemplary embodiment of the present invention is shown. The upper assembly 1002 includes the top roller support member 1004, which receives the axles of the top first rollers 902. The top roller support member 1004 is coupled to the horizontal sliding member 1006, which is further coupled to the horizontal adjustment unit interface member 1008.

The horizontal sliding member 1006 is slidably engaged with the upper flattener support member 1010. The upper flattener support member 1010 is coupled to the horizontal adjustment unit 810, which is further coupled through a window 1012 in the upper flattener support member 1010 to the top roller support member 1004 via the horizontal adjustment unit interface member 810. In an exemplary embodiment, the portion of the horizontal adjustment unit 810 that is coupled to the top roller support member 1004 is threadably connected with the portion of the horizontal adjustment unit 810 that is coupled to the upper flattener support member 1010. When the wheel of the horizontal adjustment unit 810 is turned, the top roller support member 1004 is moved horizontally with respect to the bottom roller support member, as described above.

The bottom assembly 1014 includes the top horizontal roller support member 1016, which is coupled to the vertical sliding member 1020, which is in turn coupled to the vertical adjustment interface member 1022. The vertical adjustment unit 812 is coupled to the top horizontal roller support member 1016 and the bottom flattener support member 1026. With the exception of operating vertically, the vertical adjustment unit 812 operates substantially similarly to the horizontal adjustment unit 810. When the wheel is turned, the top horizontal roller 1018 moves vertically with respect to the bottom horizontal roller 1024, as described above.

Alternative embodiments of the system for manufacturing wire will become apparent to one of ordinary skill in the art to which the present invention pertains without departing from its spirit and scope. Thus, although this invention has been described in exemplary form with a certain degree of particularity, it should be understood that the present disclosure has been made only by way of example and that numerous changes in the details of construction and the combination and arrangement of parts or steps may be resorted to without departing from the spirit or scope of the invention. Accordingly, the scope of the present invention is defined by the appended claims rather than the foregoing description.

What is claimed is:

1. A system for manufacturing enameled wire, the system comprising:

a mill configured to simultaneously process a plurality of wires, the mill comprising:

a plurality of first dies, each first die configured to receive a respective wire included in the plurality of wires and reduce the cross-sectional area of the wire as it passes through the first die;

a plurality of first capstans, each first capstan configured to receive a respective wire from a corresponding first die and apply a first force on the wire;

a plurality of second dies, each second die configured to receive a respective wire from a corresponding first capstan and to further reduce the cross-sectional area of the wire as it passes through the second die; and a plurality of second capstans, each second capstan configured to receive a respective wire from a corresponding second die and apply a second force on the wire; and an enameller configured to receive the plurality of wires in a continuous fashion from the mill, and to apply an enamel to each wire.

2. The system of claim 1, wherein the plurality of wires are not stored on one or more spools during the period between their output from the mill and their entrance into the enameller.

3. The system of claim 1, wherein, prior to being provided to the mill, at least one of the plurality of wires comprises rod stock.

4. The system of claim 1, wherein, prior to being provided to the enameller, at least one of the plurality of wires has a cross-sectional area between approximately 4 AWG and approximately 16 AWG.

5. The system of claim 1, wherein the mill further comprises a flattener configured to receive at least one of the plurality of wires and flatten at least two sides of the at least one wire.

6. The system of claim 5, wherein the flattener is configured to flatten the at least one wire to produce a wire that is substantially rectangular in cross section after exiting the flattener.

7. The system of claim 5, wherein the flattener comprises a roller.

8. The system of claim 1, wherein each of the plurality of first capstans and the plurality of second capstans are driven by an individual motor.

9. The system of claim 8, wherein each motor is controlled by a computer.

10. The system of claim 1, wherein the mill further comprises:

a plurality of third dies, each third die configured to receive a respective wire from a corresponding second capstan and to further reduce the cross-sectional area of the wire as it passes through the third die; and a plurality of third capstans, each third capstan configured to receive a respective wire from a corresponding third die and apply a third force to the wire.

11. The system of claim 10, wherein the mill further comprises:

a plurality of fourth dies, each fourth die configured to receive a respective wire from a corresponding third capstan and to further reduce the cross-sectional area of the wire as it passes through the fourth die; and a plurality of fourth capstans, each fourth capstan configured to receive a respective wire from a corresponding fourth die and apply a fourth force to the wire.

12. The system of claim 1, wherein each of the first capstans further comprise at least one groove configured to receive the wire.

13. The system of claim 12, wherein the at least one groove comprises a base and a side, wherein the base is angled with respect to the side so as to guide the wire toward the side.

14. A system for manufacturing enameled wire, the system comprising:

a mill comprising:

a plurality of wire lines that simultaneously process a plurality of wires, each wire line comprising:

a first die configured to receive a respective wire included in the plurality of wires and reduce the cross-sectional area of the wire as it passes through the first die;

a first capstan configured to receive the wire from the first die and apply a first force on the wire;

a second die configured to receive the wire from the first capstan, and to further reduce the cross-sectional area of the wire as it passes through the second die; and a second capstan configured to receive the wire from the second die and apply a second force on the wire, wherein the first capstans are driven by at least one first motor and the second capstans are driven by at least one second motor; and an enameller configured to receive the plurality of wires from the mill in uncut form and to apply enamel to the plurality of wires, wherein at least one computer controls the speeds of the at least one first motor and the at least one second motor in order to synchronize operation of the mill and the enameller.

15. The system of claim 9, wherein the computer controls the speed of each motor based at least in part on the enameller speed.

16. The system of claim 15, wherein the computer controls the speed of each motor based at least in part on one or more of (i) the diameters of the plurality of first dies, (ii) the diameters of the plurality of second dies, (iii) the input sizes of the plurality of wires provided to the mill, or (iv) desired output sizes of the plurality of wires exiting the mill.

17. The system of claim 3, wherein the rod stock has a diameter of approximately 0.3125 inches.

18. The system of claim 14, wherein the at least one computer controls the speeds of the at least one first motor and the at least one second motor based at least in part on one or more of (i) a diameter of the first die, (ii) a diameter of the second die, (iii) an input size of a wire included in the plurality of wires provided to the mill, or (iv) a desired size of a wire included in the plurality of wires provided to the enameller.

19. The system of claim 14, wherein at least one of the plurality of wire lines further comprises a flattener configured to flatten at least two sides of the wire processed by the at least one wire line.

20. The system of claim 14, wherein at least one of the plurality of wires input into the mill comprises rod stock.

* * * * *